US009357853B2

(12) United States Patent
Oh

(10) Patent No.: US 9,357,853 B2
(45) Date of Patent: Jun. 7, 2016

(54) HYBRID BABY CARRIER

(71) Applicant: Se-Ho Oh, Osan (KR)

(72) Inventor: Se-Ho Oh, Osan (KR)

( * ) Notice: Subject to any disclaimer, the term of this patent is extended or adjusted under 35 U.S.C. 154(b) by 0 days.

(21) Appl. No.: 14/622,518

(22) Filed: Feb. 13, 2015

(65) Prior Publication Data

US 2015/0230623 A1 Aug. 20, 2015

(30) Foreign Application Priority Data

Feb. 20, 2014 (KR) ..... 10-2014-0019431

(51) Int. Cl.
*A47D 13/02* (2006.01)

(52) U.S. Cl.
CPC ..... *A47D 13/025* (2013.01)

(58) Field of Classification Search
CPC ..... A45F 3/04; A45F 3/08; A45F 4/02; B62B 5/068; A47D 13/025
USPC ..... 224/159–161
See application file for complete search history.

(56) References Cited

U.S. PATENT DOCUMENTS 5,769,431 A * 6/1998 Cordova ..... B62B 5/068 280/1.5
6,467,559 B1 * 10/2002 Farrell ..... A63C 11/10 180/180
8,893,937 B1 * 11/2014 Bristol ..... B62B 5/068 224/153
2006/0163305 A1 * 7/2006 Tong ..... A45F 3/08 224/628
2006/0240960 A1 * 10/2006 Shahinpoor ..... A63B 9/18 482/121
2009/0032558 A1 * 2/2009 Klein, II ..... A47D 13/025 224/161
2010/0051657 A1 * 3/2010 Onessimo ..... A45C 3/00 224/153
2013/0228602 A1 * 9/2013 Thiruppathi ..... A45C 13/385 224/625

FOREIGN PATENT DOCUMENTS

KR 20-0451424 Y1 12/2010
KR 10-1219312 B1 1/2013
KR 10-1272144 B1 6/2013

* cited by examiner

*Primary Examiner* — Corey Skurdal

(57) ABSTRACT

Provided is a hybrid baby carrier capable of reducing a load of weight of a baby that is transferred to a guardian who wears a baby carrier. In accordance with an embodiment of the present invention, the hybrid baby carrier may include a main body configured to form a space where a baby is seated, a strap connected to the main body and configured to be worn by a guardian so that the guardian supports the load of the baby, and a support unit downwardly extended from the main body and configured to distribute the load of the baby toward a ground.

14 Claims, 7 Drawing Sheets

HYBRID BABY CARRIER

CROSS-REFERENCE TO RELATED APPLICATIONS

Priority to Korean patent application number 10-2014-0019431 filed on Feb. 20, 2014 the entire disclosure of which is incorporated by reference herein, is claimed.

BACKGROUND OF THE INVENTION

1. Field of the Invention

The present invention relates to a hybrid baby carrier and, more particularly, to a hybrid baby carrier that is used to hold a baby or carry the baby on the back.

2. Related Art

In general, a baby carrier is used as substitute for a wadded baby wrapper that is used to hold a baby or carry the baby on the back. The baby carrier enables a baby to be supported to a guardian through shoulder straps. The baby carrier closely attaches a baby to the back or waist of a guardian. Accordingly, the baby carrier is advantageous in that that it enables a guardian to more easily hold a baby or carry the baby on the back. In particular, a hip-seat baby carrier prevents the droop of a baby. Accordingly, the hip-seat baby carrier enables a guardian who has worn the baby carrier to stably hold a baby or carry the baby on the back.

A prior art of the hip-seat baby carrier has been disclosed in Korean Patent No. 10-1272144 (May 31, 2013) entitled "Hip Seat Baby Carrier." The prior art includes a baby carrier main body unit and a hip seat unit. The baby carrier main body unit is configured to surround the hips and back of a baby and worn by a guardian through shoulder straps. The hip seat unit is coupled with the lower part of the baby carrier main body unit and supports the hips of the baby. Accordingly, according to the prior art, a guardian who uses the baby carrier can stably hold a baby or carry the baby on the back through the shoulders and the waist.

In the prior art, however, weight of a baby is concentrated on the shoulders or waist of a guardian who wears the baby carrier. Accordingly, the prior art is problematic in that a load is added to the shoulders, waist, and knees of the guardian. In particular, when a guardian who holds a baby or carries the baby on the back uses the baby carrier, a load transferred to joints is weighted because most of the guardians are women who gave birth to children. Accordingly, the prior art is problematic in that it is difficult for women who gave birth to children to use the baby carrier.

PRIOR ART DOCUMENT

Patent Document

Korean Patent No. 10-1272144 (May 31, 2013) entitled "Hip Seat Baby Carrier"

SUMMARY OF THE INVENTION

An object of the present invention is to provide a hybrid baby carrier capable of reducing a load of weight of a baby that is transferred to a guardian who wears a baby carrier.

In an aspect, there is a hybrid baby carrier, including a main body configured to form a space where a baby is seated, a strap connected to the main body and configured to be worn by a guardian so that the guardian supports the load of the baby, and a support unit downwardly extended from the main body and configured to distribute the load of the baby toward a ground.

The hybrid baby carrier may further include a transfer roller connected to the lower end of the support unit.

The main body and the support unit may be rigidly connected so that the main body is rotated along with the support unit.

The support unit may comprise a bending portion.

The support unit may include a first support frame connected to the main body, a second support frame axially connected to the first support frame and configured to distribute the load of the baby toward the ground, and angle control means configured to limit the rotation of the second support frame between the first and the second support frames so that an included angle is maintained between the first and the second support frames.

The length of at least one of the first and the second support frames may be controllable depending on height of the guardian.

The first support frame may include a first frame connected to the main body and configured to have at least one first coupling hole formed in the first frame in the length direction, a second frame configured to have a hollow into which the first frame is inserted and through which the first frame goes up and down and a second coupling hole corresponding to the first coupling hole formed in the second frame, and a coupling pin coupled to the first and the second coupling holes in order to maintain the length of the first support frame in a state in which height of the first frame has been controlled.

The hybrid baby carrier may further include a support plate connected to the lower end of the support unit, a first transfer roller connected to the support plate, and at least one second transfer roller connected to the support plate and configured to prevent the first transfer roller from slipping while the main body is transferred.

The hybrid baby carrier may further include a first transfer roller connected to the lower end of the support unit and a second transfer roller disposed between the first transfer roller and the guardian and connected to a frame extended from the support unit.

The frame may be downwardly extended between the first transfer roller and the guardian and configured to support the second transfer roller to the ground.

The hybrid baby carrier may further include a waist support unit disposed between the baby and the guardian and configured to maintain a posture of the guardian.

The waist support unit is closely attached to at least any one of the lumbar vertebrae and backbone of the guardian when the guardian carries the baby on the back.

The waist support unit may be closely attached to the abdomen of the guardian when the guardian holds the baby.

The waist support unit may be divided into a plurality of supports units, and the plurality of supports units may be closely attached to both sides of the body of the guardian.

The main body may include a seating unit configured to support the hip and back portions of the baby and guard frames configured to secure a seating space of the baby in order to prevent the seating unit from pressurizing the baby while the main body moves.

The hybrid baby carrier may further include a shock-absorbing unit configured to reduce a shock transferred to the baby while the main body moves. The shock-absorbing unit may include a sheet type damper disposed on the upper part of the support unit and a shock absorber disposed on the lower part of the support unit.

The hybrid baby carrier in accordance with an embodiment of the present invention has an advantage in that a load of weight of a baby transferred to a guardian can be reduced because the load of the baby transferred to the guardian is distributed.

Advantages of the present invention are not limited to the aforementioned advantage and may include various other advantages that are evident to those skilled in the art to which the present invention pertains from the following description.

DESCRIPTION OF EXEMPLARY EMBODIMENTS

Figure 1:
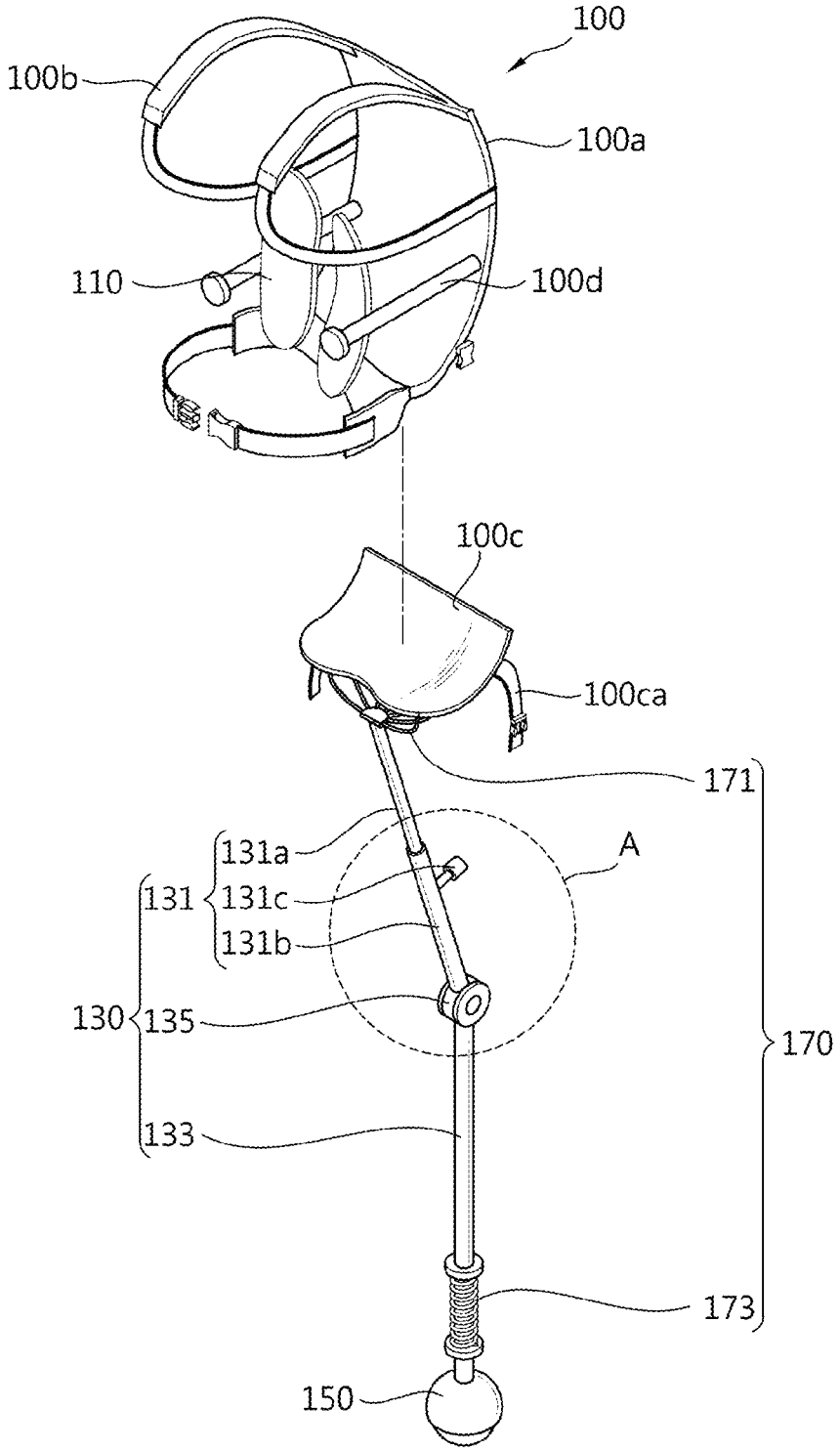
FIG. 1 is a perspective view of a hybrid baby carrier according to a first embodiment.

Hereinafter, some embodiments of the present invention are described in detail with reference to the accompanying drawings. However, the present invention is not limited to the disclosed embodiments, but may be implemented in various ways. The present embodiments are provided to complete the disclosure of the present invention and to allow those skilled in the art to understand the scope of the present invention. The shapes, etc., of elements in the drawings may be enlarged in order to highlight a clearer description. The same reference numbers are used throughout the drawings to refer to the same parts.

Hybrid baby carriers according to some embodiments of the present invention are combinations of advantages of a conventional baby carrier and a baby carriage. Hereinafter, the constructions of hybrid baby carriers are described in detail.

Figure 2:
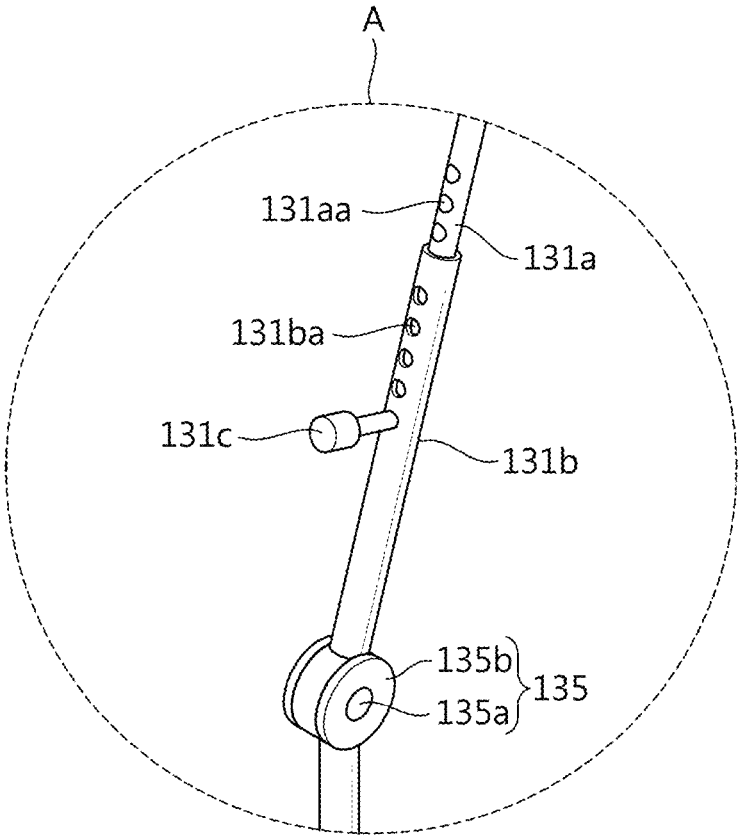
FIG. 2 is a perspective view of the support unit of the hybrid baby carrier according to the first embodiment.

FIG. 1 is a perspective view of a hybrid baby carrier according to a first embodiment, and FIG. 2 is a perspective view of the support unit of the hybrid baby carrier according to the first embodiment.

As illustrated in FIGS. 1 and 2, the hybrid baby carrier 100 (hereinafter referred to as the "baby carrier") according to the first embodiment may include a main body 100*a*.

The main body 100*a* enables a baby 10 (see FIG. 3) to be supported to a guardian 30 (see FIG. 3) who wears the baby carrier 100. The main body 100*a* may be made of flexible materials. Furthermore, the main body 100*a* may be configured to support the back and hip portions of the baby 10.

The main body 100*a* may be supported to the guardian 30 by a strap 100*b*. The strap 100*b* may be provided in such a way as to be carried on both the shoulders of the guardian 30 or to be carried on the shoulder and waist of the guardian 30. Furthermore, the strap 100*b* may have a length that is varied depending on the body structure of the guardian 30.

Furthermore, the main body 100*a* may include a seating unit 100*c* and guard frames 100*d*.

The seating unit 100*c* forms a space where the baby 10 is seated. The seating unit 100*c* simultaneously supports the hip portions of the baby 10 or the hip and back portions of the baby 10. In this case, the seating unit 100*c* may be provided in a sheet form in order to support the hip portions of the baby 10. Furthermore, the seating unit 100*c* may be provided in a bent sheet form in order to simultaneously support the hip and back portions of the baby 10. Furthermore, a cushion, such as rubber, cotton, or sponge, may be provided on a surface of the seating unit 100*c* in order to improve heat insulation and a sense of seating of the baby 10.

The seating unit 100*c* may be separated from the main body 100*a*. The main body 100*a* and the seating unit 100*c* may be equipped with attachment/detachment means 100*ca*, such as Velcro or a combination of a strap and a fixing clip.

The guard frames 100*d* function to prevent the seating unit 100*c* from pressurizing the baby 10 while the main body 100*a* is in motion. That is, the guard frames 100*d* enables the seating space of the baby 10 to be secured. The guard frames 100*d* are disposed between the seating unit 100*c* and the guardian 30. The guard frames 100*d* function to prevent the seating unit 100*c* from rotating toward the guardian 30 while the main body 100*a* moves.

It is to be noted that the aforementioned materials and shape of the main body 100*a* are only an embodiment provided in order to describe the present embodiment. The present invention is not limited to the materials and shape of the main body 100*a* in accordance with an embodiment of the present invention.

A waist support unit 110, a support unit 130, a transfer roller 150, and a shock-absorbing unit 170 may be connected to the main body 100*a*.

The waist support unit 110 is connected to the main body 100*a* so that it is disposed between the baby 10 and the guardian 30. The waist support unit 110 may be provided in a sheet form. Furthermore, the waist support unit 110 may be divided into a plurality of support units in order to be more closely attached to the body of the guardian 30. Accordingly, the waist support unit 110 may be closely attached to the left and right of the body of the guardian 30. Furthermore, a cushion, such as rubber, cotton, or sponge, may be provided on a surface of the waist support unit 110.

The waist support unit 110 may be closely attached to the back portion or abdomen portion of the guardian 30.

Figure 3:
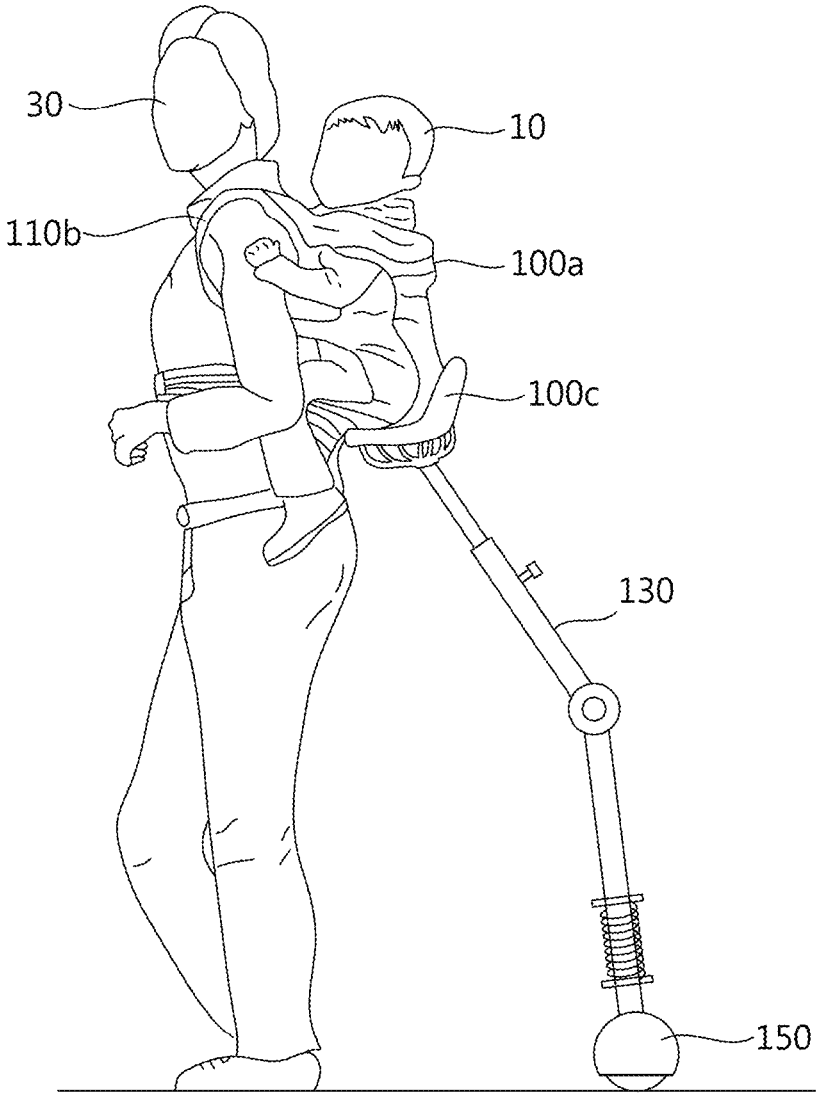
FIG. 3 is a diagram illustrating a first state in which a person has worn the hybrid baby carrier according to the first embodiment.
Figure 4:
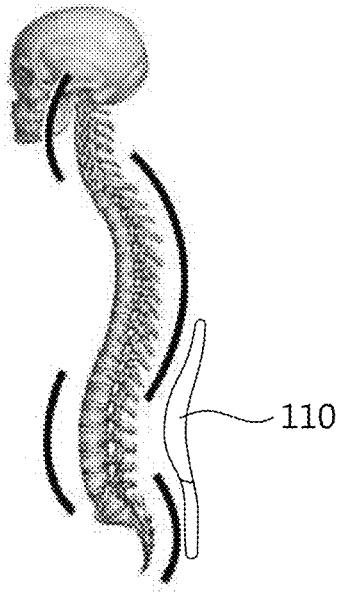
FIG. 4 is a diagram illustrating the state in which the waist support unit of the hybrid baby carrier according to the first embodiment supports the back portion of a guardian.

FIG. 3 is a diagram illustrating a first state in which a person has worn the hybrid baby carrier according to the first embodiment, and FIG. 4 is a diagram illustrating the state in which the waist support unit of the hybrid baby carrier according to the first embodiment supports the back portion of a guardian.

As illustrated in FIGS. 3 and 4, the waist support unit 110 may be closely attached to the back portion of the guardian 30. Furthermore, the main body 100*a* may be supported to the guardian 30 so that the baby 10 is carried on the back of the guardian 30. In this case, the waist support unit 110 enables the main body 100*a* to be closely attached to the guardian 30. Furthermore, the waist support unit 110 is disposed adjacent to the back portion (lumbar vertebrae and/or backbone) of the guardian 30. Accordingly, a correct posture of the guardian 30 can be maintained by the waist support unit 110.

Furthermore, the waist support unit 110 may have a curved surface that is protruded toward the back portion of the guardian 30. Accordingly, the waist support unit 110 can maintain a correct posture of the guardian 30. Furthermore, the waist support unit 110 can reduce a load applied to the back portion of the guardian 30.

Figure 5:
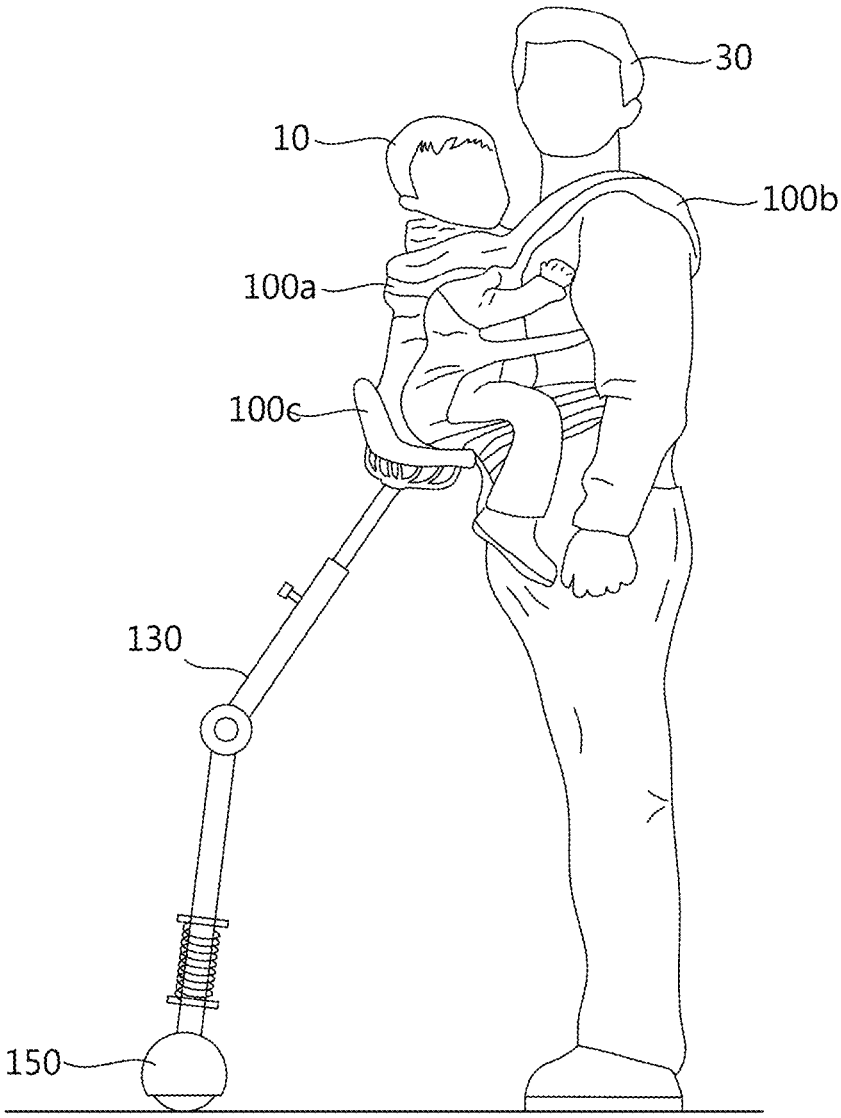
FIG. 5 is a diagram illustrating a second state in which a person has worn the hybrid baby carrier according to the first embodiment.

FIG. 5 is a diagram illustrating a second state in which a person has worn the hybrid baby carrier according to the first embodiment.

As illustrated in FIG. 5, the waist support unit 110 may be closely attached to the abdomen portion of the guardian 30. Furthermore, the main body 100*a* may be supported to the guardian 30 so that the baby 10 is nestled in the guardian 30. In this case, the waist support unit 110 is closely attached to the abdomen portion of the guardian 30. Accordingly, the waist support unit 110 indirectly supports the waist of the guardian 30. Accordingly, a correct posture of the guardian 30 can be maintained by the waist support unit 110.

As described above, the waist support unit 110 closely attaches the main body 100*a* to the guardian 30. Accordingly, the guardian 30 can hold the baby 10 or carry the baby on the back more easily. Furthermore, the waist support unit 110 maintains a correct posture of the guardian 30. Accordingly, the waist support unit 110 is advantageous in that it can reduce a load of weight of the baby 10 that is transferred to the guardian 30 and a sense of fatigue of the guardian 30.

Referring back to FIGS. 1 and 2, the support unit 130 may be extended from the bottom of the seating unit 100*c* to the ground. The support unit 130 may be rigidly connected to the seating unit 100*c* so that the seating unit 100*c* is rotated along with the support unit 130.

The support unit 130 may include a first support frame 131, a second support frame 133, and angle control means 135.

First, the first support frame 131 may be connected to the bottom of the seating unit 100*c*. In this case, the first support frame 131 may be detachably connected to the seating unit 100*c*. Furthermore, the length of the first support frame 131 may be expanded or contracted. The first support frame 131 may include a first frame 131*a*, a second frame 131*b*, and a coupling pin 131*c*.

The first frame 131*a* has a top detachably connected to the bottom of the seating unit 100*c*. Furthermore, a hollow into which the first frame 131*a* is inserted and through which the first frame 131*a* may go up and down is formed in the second frame 131*b*. Accordingly, the first frame 131*a* may be inserted into the hollow of the second frame 131*b* and may go up and down within the second frame 131*b*. Furthermore, the coupling pin 131*c* couples the first and the second frames 131*a* and 131*b* through coupling holes formed in the first and the second frames 131*a* and 131*b*. Accordingly, the coupling pin 131*c* may function to maintain a varying length of the first support frame 131.

That is, a plurality of first coupling holes 131*aa* may be formed in the first frame 131*a* in the length direction thereof. A plurality of second coupling holes 131*ba* corresponding to the first coupling hole 131*aa* may be formed in the second frame 131*b*. Furthermore, the coupling pin 131*c* penetrates first and second coupling holes 131*aa* and 131*ba* that are selected when the length of the first support frame 131 is changed. Accordingly, the first and the second frames 131*a* and 131*b* may be coupled.

As described above, the first support frame 131 enables height of the support unit 130 to be controlled depending on the height of the guardian 30 who supports the baby carrier 100. Furthermore, the first support frame 131 may be separated from the seating unit 100*c*, if necessary. Accordingly, portability and mobility convenience of the support unit 130 can be improved.

The second support frame 133 may have a top connected to the first support frame 131 and a bottom connected to the transfer roller 150. The second support frame 133 may have an angle controlled with respect to the first support frame 131. That is, the second support frame 133 has an angle controlled with respect to the first support frame 131 and maintains the support unit 130 in a curved state. Accordingly, support unit 130 comprises a bending portion.

To this end, the angle control means 135 may be disposed between the first and the second support frames 131 and 133. The angle control means 135 may include a connection shaft 135*a* and an angle control unit 135*b*.

First, the connection shaft 135*a* connects the lower end of the first support frame 131 and the upper end of the second support frame 133. Accordingly, the second support frame 133 can be rotated with respect to the first support frame 131. Furthermore, the angle control unit 135*b* is connected to the connection shaft 135*a*. The angle control unit 135*b* restricts the rotation of the second support frame 133 with respect to the first support frame 131 in order to maintain a rotation angle of the second support frame 133. That is, the angle control unit 135*b* maintains an included angle between the first and the second support frames 131 and 133.

Furthermore, the angle control unit 135*b* enables the first and the second support frames 131 and 133 to be hinged. Accordingly, the angle control means 135 can improve portability and transfer convenience of the support unit 130.

The transfer roller 150 is connected to the lower end of the second support frame 133. The transfer roller 150 enables the main body 100*a* to be transferred in the state in which it has been supported to the ground when the guardian 30 walks. The transfer roller 150 may include a roller of a ball form in order to facilitate the transfer of the support unit 130. The transfer roller 150 may function to distribute weight of the baby 10, transferred through the support unit 130, to the ground.

Furthermore, the shock-absorbing unit 170 functions to reduce a shock that may be transferred to the baby 10 while the main body 100*a* is transferred. For example, the shock-absorbing unit 170 may include first and second shock-absorbing means 171 and 173.

The first shock-absorbing means 171 may be disposed between the seating unit 100*c* and the first support frame 131. The first shock-absorbing means 171 may include a sheet type damper. The first shock-absorbing means 171 functions to reduce a shock applied to the seating unit 100*c* due to the irregularity of the ground while the support unit 130 is transferred.

The second shock-absorbing means 173 is disposed between the transfer roller 150 and the second support frame 133. The second shock-absorbing means 173 may include a shock absorber. The second shock-absorbing means 173 functions to reduce a shock applied to the support unit 130 and the seating unit 100*c* due to the irregularities of the ground while the support unit 130 is transferred.

Hybrid baby carriers according to other embodiments are described in detail below.

Figure 6:
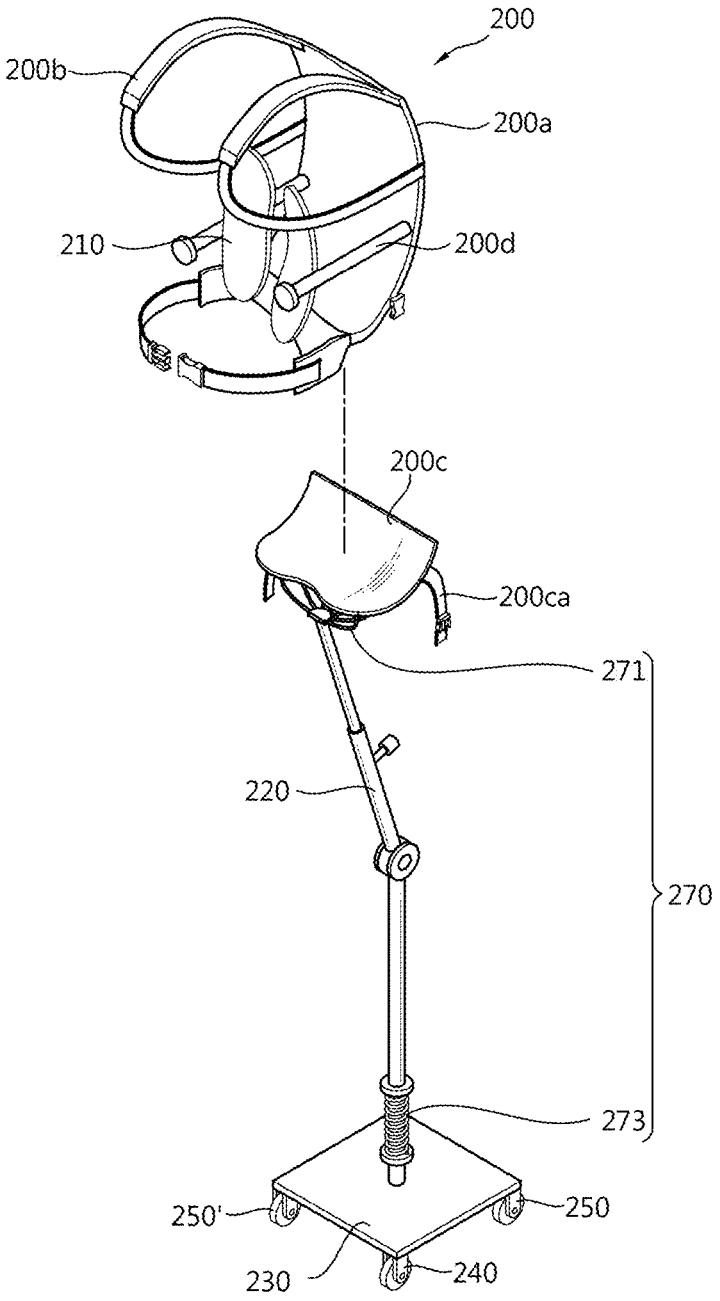
FIG. 6 is a perspective view of a hybrid baby carrier according to a second embodiment.

FIG. 6 is a perspective view of a hybrid baby carrier according to a second embodiment.

As illustrated in FIG. 6, the hybrid baby carrier 200 (hereinafter referred to as the "baby carrier") according to the second embodiment may include a main body 200*a*. The main body 200*a* has the same construction as the main body 100*a* (see FIG. 1) of the first embodiment and may include a seating unit 200*c* and guard frames 200*d*. The seating unit 200*c* and the guard frames 200*d* have the same configurations as the seating unit 100*c* and guard frames 100*d* of the first embodiment.

Furthermore, a waist support unit 210, a support unit 220, a support plate 230, a first transfer roller 240, a second transfer roller 250, and a shock-absorbing unit 270 may be connected to the main body 200*a*. The waist support unit 210, the support unit 220, and the shock-absorbing unit 270 have the same configurations as the waist support unit 110, support unit 130, and shock-absorbing unit 170 of the first embodiment.

Accordingly, the support plate 230, the first transfer roller, 240 and the second transfer roller 250 are described in detail below.

The support plate 230 is connected to the lower end of the support unit 220. The support plate 230 supports the support unit 220. The support plate 230 enables the baby carrier 200 to stand independently. Furthermore, the first and the second transfer rollers 240 and 250 may be connected to the support plate 230.

The first transfer roller 240 is connected to the support plate 230. When the guardian 30 walks, the first transfer roller 240 enable the main body 200*a* to be transferred in the state in which the main body 200*a* has been supported to the ground. The first transfer roller 240 may include a roller of a ball type in order to facilitate the transfer of the support unit 220.

Furthermore, the second transfer roller 250 is connected to the support plate 230. The second transfer roller 250, together with the first transfer roller 240, enable the main body 200*a* to be transferred in the state in which the main body 200*a* has been supported to the ground. A plurality of the second transfer rollers 250 may be used in order to prevent the support unit 220 from slipping while the main body 200 is transferred. In this case, the plurality of second transfer rollers 250 may be connected to the support plate 230 so that the support unit 220 stands independently. Furthermore, the second transfer roller 250 may include a roller of a ball type in order to facilitate the transfer of the support unit 220.

Figure 7:
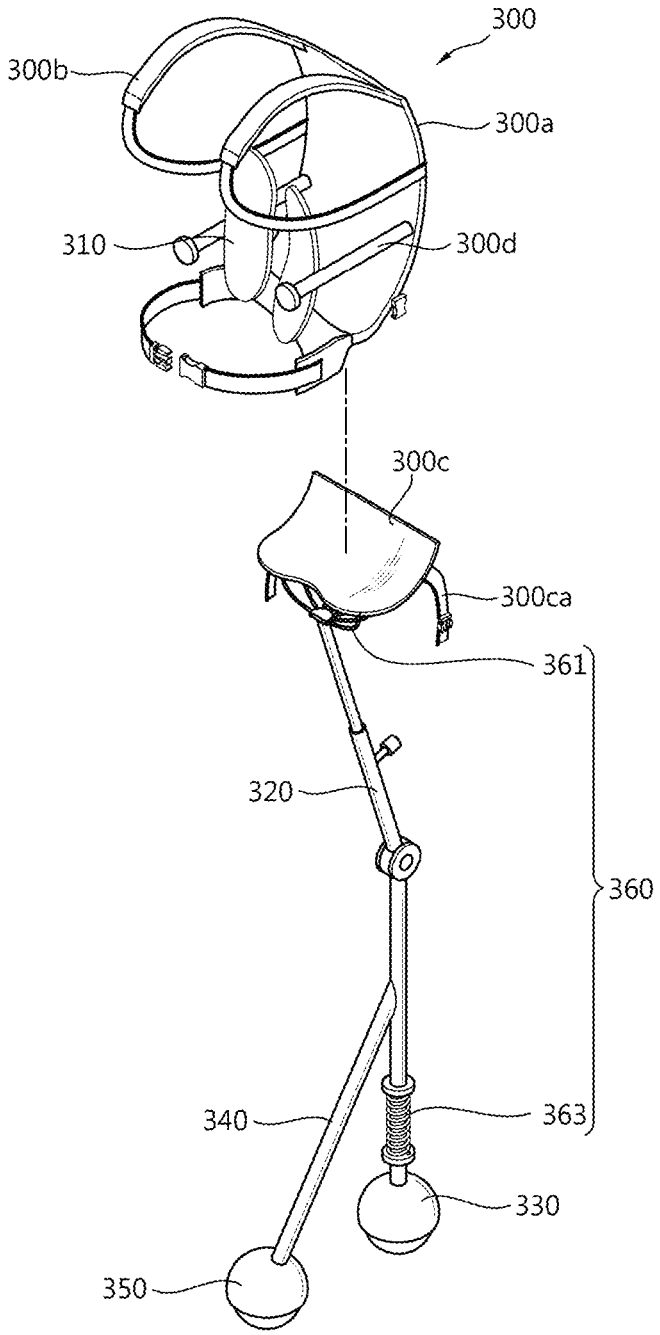
FIG. 7 is a perspective view of a hybrid baby carrier according to a third embodiment.

FIG. 7 is a perspective view of a hybrid baby carrier according to a third embodiment.

As illustrated in FIG. 7, the hybrid baby carrier 300 according to the third embodiment may include a main body 300*a*. The main body 300*a* has the same construction as the main body 100*a* of the first embodiment and may include a seating unit 300*c* and guard frames 300*c*.

Furthermore, a waist support unit 310, a support unit 320, a first transfer roller 330, a roller frame 340, a second transfer roller 350, and a shock-absorbing unit 360 may be connected to the main body 300*a*. The waist support unit 310, the support unit 320, and the shock-absorbing unit 360 have the same constructions as the waist support unit 110, the support unit 130, and the shock-absorbing unit 170 of the first embodiment.

Accordingly, the first transfer roller 330, the roller frame 340, and the second transfer roller 350 are described in detail below.

The first transfer roller 330 is connected to the lower end of the support unit 320. The first transfer roller 330 enables the main body 300*a* to be transferred in the state in which the main body 300*a* has been supported to the ground when the guardian 30 walks. The first transfer roller 330 may include a roller of a ball type in order to facilitate the transfer of the support unit 320.

The roller frame 340 connects the support unit 320 and the second transfer roller 350. The roller frame 340 has one end connected to the support unit 320 and the other end downwardly extended from the support unit 320 so that the second transfer roller 350 is supported to the ground. The roller frame 340 is extended from the support unit 320 between the first transfer roller 330 and the guardian 30.

The second transfer roller 350 is connected to the lower end of the roller frame 340. The second transfer roller 350, together with the first transfer roller 330, enables the main body 300*a* to be transferred in the state in which the main body 300*a* has been supported to the ground. The second transfer roller 350 prevents the support unit 320 from slipping in a direction opposite the transfer direction of the main body 300*a* while the main body 300*a* is transferred. The second transfer roller 350 may include a roller of a ball type in order to facilitate the transfer of the support unit 320.

The embodiments of the present invention described above and shown in the drawings should not be construed as limiting the technical spirit of the present invention. The scope of the present invention is restricted by only the claims, and those skilled in the art to which the present invention pertains may improve and modify the technical spirit of the present invention in various forms. Accordingly, the modifications and modifications will fall within the scope of the present invention as long as they are evident to those skilled in the art.

What is claimed is:

1. A hybrid baby carrier, comprising:

a main body configured to form a space where a baby is seated;

a strap connected to the main body and configured to be worn by a guardian so that the guardian supports a weight of the baby; and a support unit downwardly extending from the main body and configured to distribute the weight of the baby toward a ground, wherein the support unit comprises:

a bending portion;

a first support frame connected to the main body;

a second support frame axially connected to the first support frame and configured to distribute the weight of the baby toward the ground; and an angle control means configured to limit a rotation of the second support frame with respect to the first support frame so that an angle between the first and second support frames is maintained.

2. The hybrid baby carrier of claim 1, further comprising a transfer roller connected to a lower end of the support unit.

3. The hybrid baby carrier of claim 1, wherein the main body and the support unit are rigidly connected so that the main body is rotated along with the support unit.

4. The hybrid baby carrier of claim 1, wherein a length of at least one of the first and second support frames is adjustable depending on a height of the guardian.

5. The hybrid baby carrier of claim 1, wherein the first support frame comprises:

a first frame connected to the main body and configured to have one or more of first coupling holes arranged in a lengthwise direction;

a second frame configured to have a hollow into which the first frame is inserted and through which the first frame moves along the lengthwise direction, the second frame having a second coupling hole corresponding to one of the first coupling holes of the first frame; and a coupling pin coupled to the one of the first coupling holes of the first frame and the second coupling hole of the second frame in order to maintain a length of the first support frame after the length of the first frame has been adjusted.

6. The hybrid baby carrier of claim 1, further comprising:

a support plate connected to a lower end of the support unit;

a first transfer roller connected to the support plate; and at least one second transfer roller connected to the support plate and configured to prevent the first transfer roller from slipping while the main body is transferred.

7. The hybrid baby carrier of claim 1, further comprising:

a first transfer roller connected to a lower end of the support unit; and a second transfer roller disposed adjacent to the first transfer roller and connected to a roller frame extending from the support unit.

8. The hybrid baby carrier of claim 7, wherein the roller frame extends obliquely from the second support frame such that the second transfer roller is supported on the ground.

9. The hybrid baby carrier of claim 1, further comprising a waist support unit disposed between the baby and the guardian and configured to maintain a posture of the guardian.

10. The hybrid baby carrier of claim 9, wherein the waist support unit contacts at least any one of a lumbar vertebrae and a backbone of the guardian when the guardian carries the baby on the guardian's back.

11. The hybrid baby carrier of claim 9, wherein the waist support unit contacts an abdomen of the guardian when the guardian holds the baby.

12. The hybrid baby carrier of claim 9, wherein:

the waist support unit includes a plurality of supports units; and the plurality of supports units contacts both sides of the body of the guardian.

13. The hybrid baby carrier of claim 1, wherein the main body comprises:

a seating unit configured to support a hip portion or a back portion of the baby; and guard frames configured to secure a seating space of the baby in order to prevent the seating unit from pressurizing the baby while the main body moves.

14. The hybrid baby carrier of claim 9, further comprising a shock-absorbing unit configured to reduce a shock transferred to the baby while the main body moves, wherein the shock-absorbing unit comprises a sheet type damper disposed on an upper part of the support unit and a shock absorber disposed on a lower part of the support unit.

* * * * *